US006302181B1

(12) United States Patent
Rupel

(10) Patent No.: US 6,302,181 B1
(45) **Date of Patent: *Oct. 16, 2001**

(54) WINDOW COVERING WITH ARTIFICIAL CREASES AND METHOD OF MANUFACTURING SAME

(75) Inventor: John D. Rupel, Verona, WI (US)

(73) Assignee: Springs Window Fashions LP, Fort Mill, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/226,060

(22) Filed: Jan. 5, 1999

Related U.S. Application Data

(60) Provisional application No. 60/070,667, filed on Jan. 7, 1998.

(51) Int. Cl.[7] ..... E06B 9/06

(52) U.S. Cl. ..... 160/84.05; 160/DIG. 7

(58) Field of Search ..... 160/84.04, 84.05, 160/84.01, DIG. 7, 237; 428/116, 118; 156/197

(56) References Cited

U.S. PATENT DOCUMENTS

| | | | | |
|---|---|---|---|---|
| Re. 31,129 | | 1/1983 | Rasmussen . | |
| 2,201,356 | | 5/1940 | Terrell . | |
| 3,443,860 | * | 5/1969 | Luboshez | 160/84.04 X |
| 3,963,549 | | 6/1976 | Rasmussen . | |
| 4,288,485 | | 9/1981 | Souminen . | |
| 4,346,132 | | 8/1982 | Cheng et al. . | |
| 4,347,887 | | 9/1982 | Brown . | |
| 4,603,072 | | 7/1986 | Colson . | |
| 4,625,786 | | 12/1986 | Carter et al. . | |
| 4,631,217 | | 12/1986 | Anderson . | |
| 4,677,012 | | 6/1987 | Anderson . | |
| 4,884,612 | * | 12/1989 | Schnebly et al. | 160/84.04 |
| 5,160,563 | * | 11/1992 | Kutchmarek et al. | 156/204 |
| 5,664,613 | * | 9/1997 | Jelic | 160/84.05 |
| 5,691,031 | * | 11/1997 | Swiszcz et al. | 160/84.05 X |
| 5,837,084 | * | 11/1998 | Barss | 160/84.05 X |
| B1 4,603,072 | | 7/1991 | Colson . | |

* cited by examiner

*Primary Examiner*—David M. Purol
(74) *Attorney, Agent, or Firm*—Lerner, David, Littenberg, Krumholz & Mentlik, LLP

(57) ABSTRACT

Expandable and collapsible window coverings are disclosed including a web of non-rigid material and a stiffener intermittently applied to the web to provide stiffened regions along the web separated by regions of the non-rigid material. In this manner, the regions of non-rigid material can act as hinges between the stiffened regions. Methods for forming these window coverings are also disclosed.

22 Claims, 7 Drawing Sheets

WINDOW COVERING WITH ARTIFICIAL CREASES AND METHOD OF MANUFACTURING SAME

CROSS-REFERENCE TO RELATED APPLICATIONS

The present application claims benefit of U.S. Provisional Patent Application 60/070,667 filed Jan. 7, 1998. The disclosure of said Provisional Patent Application is hereby incorporated by reference herein.

FIELD OF THE INVENTION

The present invention relates to window coverings, such as pleated shades, cellular shades and soft horizontal shades, and methods of manufacturing same. More particularly, the present invention relates to a new method of providing window coverings which give the appearance of having "creases" or "pleats," which appearance is achieved without employing traditional pleating equipment or in any way forming actual creases, pleats or folds in the fabric.

BACKGROUND OF THE INVENTION

The prior art in connection with the field of window coverings such as pleated shades is replete with products many of which have been in existence for a very long period of time. From their earliest embodiments, these products have included cellular shades with various creases and pleats so as to form an accordion configuration, either in a single sheet or in multiple sheet configurations, and in connection with cellular shades which also include such creases or pleats. In connection with these cellular products, these include structures which are prepared from separate tubes or strips folded into tubular configurations and adhered together serially to form longitudinally extending cells such as those disclosed in U.S. Pat. Nos. 3,963,549 and 4,603,072. Further cellular structures are disclosed in U.S. Pat. Nos. 4,288,485 and 4,346,132, in which a number of sheets are stacked and adhered together along spaced bands forming a number of cells between adjacent sheets. Such cellular structures are also prepared from sheets which are longitudinally folded and adhered together so that each sheet forms a part of two adjacent cells. These include such structures as are shown in U.S. Pat. Nos. 4,631,217 and 4,677,012. Additionally, cellular structures can be prepared from two folded sheets disposed at opposite sides of the shade and connected together at spaced locations as in U.S. Pat. Nos. 2,201,356 and 4,625,786, for example. Also, cellular structures have been formed from single continuous sheets of material which are bonded together at spaced intervals to form adjacent cells arranged in double row configurations as in U.S. Pat. No. 4,347,887.

Again, in each of these cases, the creases or pleats are actually formed at both locations where the shade is to be folded upon its closure or collapse.

SUMMARY OF THE INVENTION

In accordance with the present invention, an improvement over this prior art has now been discovered which permits "artificial" creases to be manufactured, therefore eliminating the need to actually crease or pleat these materials in order to produce such pleated shades including cellular shades and the like.

In accordance with the present invention, this has been accomplished by the invention of an expandable and collapsible window covering comprising a web of non-rigid material and stiffening means intermittently applied to the web providing a plurality of stiffening regions along the web separated by regions of the non-rigid material, whereby the regions of non-rigid material can act as hinges between the plurality of stiffening agents to permit the web to be expanded and collapsed. In a preferred embodiment, the plurality of stiffening regions have a first longitudinal length along the web and the regions of non-rigid material have a second longitudinal length along the web, the first longitudinal length being greater than the second longitudinal length.

In accordance with one embodiment of the window covering of the present invention, the stiffening means is applied to at least one surface of the web. Preferably, the stiffening means comprises a polymeric material, which imparts rigidity to the web.

In accordance with another embodiment of the window covering of the present invention, the plurality of stiffening agents are applied to substantially the entire web, whereby the regions of non-rigid material comprise narrow intermittent regions separating the plurality of stiffening means.

In accordance with another embodiment of the window covering of the present invention, the stiffening means are applied by printing onto the web.

In accordance with another embodiment of the window covering of the present invention, the window covering includes a cord extending along the web in order to expand and collapse the web.

In accordance with another embodiment of the window covering of the present invention, the web comprises a first web, and the stiffening means comprises first stiffening means, and the window covering includes a second web of non-rigid material and connecting means for connecting the first web to the second web. In accordance with a preferred embodiment, the second web of non-rigid material includes second stiffening means intermittently applied to the second web providing a plurality of second stiffened regions along the second web separated by regions of the non-rigid material, whereby the regions of the non-rigid material can act as hinges between the plurality of second stiffened regions to permit the second web to be expanded and collapsed. In a preferred embodiment, the first and second webs comprise relatively transparent material. More particularly, the connecting means comprises a plurality of slats joining the first web to the second web intermittently therealong. In accordance with a preferred embodiment, the first stiffening means comprises a first plurality of stiffening means intermittently applied to the first web providing a first plurality of stiffened regions along the first web separated by first regions of the non-rigid material and an alternating second plurality of stiffening means intermittently applied to the first web providing a second plurality of stiffened regions along the first web separated by second regions of a non-rigid material, the alternating first and second pluralities of stiffening means separated by third regions of the non-rigid material, and the second stiffening means comprise a first plurality of stiffening means intermittently applied to the second web providing a first plurality stiffened regions along the second web separated by first regions of a non-rigid material, and an alternating second plurality of stiffening means intermittently applied to the second web providing a second plurality of stiffened regions along the second web separated by second regions of the non-rigid material, the alternating first and second pluralities of the stiffening means separated by third regions of the non-rigid material.

In accordance with another embodiment of the window covering of the present invention, the first pluralities of stiffened regions on the first and second web have a first longitudinal length and the second pluralities of stiffened regions on the first and second webs have a second longitudinal length, the first longitudinal length being greater than the second longitudinal length. In a preferred embodiment, the first regions of the non-rigid material on the first and second webs have a third longitudinal length, and the second regions of the non-rigid material on the first and second webs have a fourth longitudinal length, the third regions of the non-rigid material on the first and second webs have a fifth longitudinal length, the first longitudinal length being greater than the third, fourth and fifth longitudinal lengths. Preferably, the third, fourth and fifth longitudinal lengths are substantially the same.

In accordance with a preferred embodiment, the plurality of slats are affixed to the first and second webs at the second plurality of stiffened regions along the first and second webs, whereby the first regions of the non-rigid material along the first and second webs act as the hinges between the plurality of slats. Preferably, the plurality of slats are affixed to the second plurality of stiffening means by means of adhesive.

In accordance with a preferred embodiment of the window covering of the present invention, the window covering includes a bottom rail affixed to the first and second webs, and lift cords affixed to the bottom rail adjacent to one of the first and second webs, whereby upon lifting the lift cords one of the first and second webs is translated relative to the other of the first and second webs thereby causing the slats to pivot thereabout.

In accordance with another embodiment of the window covering of the present invention, the window covering includes a plurality of first adhesive means associated with the stiffening means on a first side of the web and a plurality of second adhesive means associated with the stiffening means on a second side of the web, the plurality of first adhesive means being affixed to the plurality of second adhesive means to form the window covering into a plurality of cells. In a preferred embodiment, each of the plurality of stiffening means includes one of the plurality of first adhesive means and one of the plurality of second adhesive means thereon. Preferably, the stiffening means comprises a resin.

In accordance with one embodiment of the window covering of the present invention, the plurality of stiffening regions are applied substantially along the entire web whereby the regions of non-rigid material comprise narrow intermittent regions separating the stiffened regions.

In accordance with the present invention, a method is also provided for forming an expandable and collapsible window covering which method comprises forming a first web of non-rigid material comprising a first plurality of stiffening means intermittently applied to the first web providing a first plurality of stiffened regions along the first web separated by first regions of the non-rigid material, and an alternating second plurality of stiffening means intermittently applied to the first web providing a second plurality of stiffened regions along the first web separated by second regions of the non-rigid material, the alternating first and second pluralities of stiffening means separated by third regions of the non-rigid material, providing a second web of non-rigid material comprising a first plurality of stiffening means intermittently applied to the second web providing a first plurality of stiffened regions along the second web separated by first regions of the non-rigid material, and an alternating second plurality of stiffening means intermittently applied to the second web providing a second plurality of stiffened regions along the second web separated by second regions of the non-rigid material, the alternating first and second pluralities of stiffening means separated by third regions of the non-rigid material, simultaneously feeding the first and second webs through a forming station with the corresponding first and second pluralities of stiffening means on the first and second web correspondingly juxtaposed with each other, feeding a plurality of slats between the first and second webs, affixing the second plurality of stiffened regions along the first and second webs to opposite surfaces of each of the plurality of slats to thereby affix the first web to the second web, and urging the portions of the first and second webs between the plurality of slats including the first plurality of stiffened regions inwardly so as to form hinges at the first regions of the non-rigid material in the first and second webs.

In accordance with the present invention, a method has also been provided for forming an expandable and collapsible window covering which comprises forming a web of non-rigid material comprising a plurality of stiffening means intermittently applied to the web thereby providing a plurality of stiffened regions along the web separated by regions of the non-rigid material, applying a first plurality of adhesive means on a first side of the stiffened regions and applying a second plurality of adhesive means on the opposite surface of the stiffened regions, the first and second pluralities of adhesive means being longitudinally spaced from each other, and forming the web in a zigzag configuration into a plurality of pleats such that the adhesive on one pleat join with the stiffened regions on an adjacent pleat, and such that the regions of non-rigid material are positioned at the exterior of the window covering to function as creases.

It has thus been discovered that an "artificial" crease can be manufactured by selectively depositing a stiffening agent onto selected portions of a soft fabric. The stiffening agent is applied in a pattern whereby thin spaces are left between segments of stiffened material, which results in the unstiffened lines of material taking on the characteristics of a soft crease.

The present invention can therefore be employed in the preparation of a considerable variety of window coverings. In its simplest form, the present invention can be employed to manufacture a common "accordion" type pleated shade made from a single layer of selectively stiffened fabric. However, the present invention can also be employed to manufacture "soft horizontal" window shades of the type which has two outer sheets of relatively transparent material connected by horizontally aligned "slats" which can be rotated, through relative movement of the outer sheets, between a first position in which the slats block the passage of light, and a second position in which the slats permit the passage of light. The present invention can also be employed to manufacture cellular shades of the type exemplified by CRYSTALPLEAT® shades sold by Springs Window Fashions Division, Inc. of Middleton, Wis., which have two staggered rows of cells manufactured from a single web of material.

BRIEF DESCRIPTION OF THE DRAWINGS

The present invention may be more fully appreciated with reference to the following detailed description, which in turn refers to the drawings, in which.

DETAILED DESCRIPTION

Figure 1:
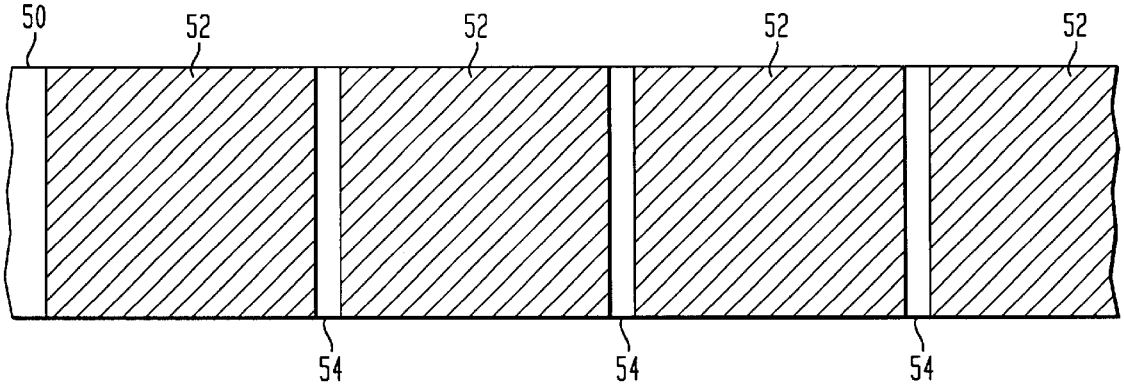
FIG. 1 is a top, elevational view of a portion of the web of material used to prepare a window covering in accordance with the present invention.
Figure 2:
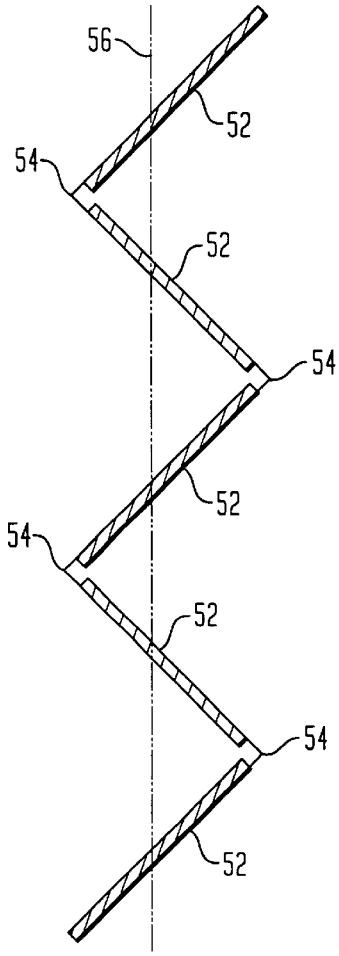
FIG. 2 is a side, elevational view of a portion of a window covering made from the web shown in FIG. 1.

Referring to the drawings, in which like reference numerals refer to like elements thereof, FIGS. 1 and 2 illustrate a first embodiment of the present invention. A web of material 50, which can be any soft woven knit, or non-woven fabric, is treated in areas 52 with a stiffening agent. The stiffening agent can be any appropriate material, such as a polymeric material which can impart rigidity to the web. Such polymeric materials can thus include polyvinyl acetates, polyvinyl alcohols, acrylates, or blends of these materials. These polymers are sold by companies such as BF Goodrich, Rohm and Haas, Sequa and others.

The stiffening material may be applied through the use of existing and available equipment, such as the "screen-to-screen" coating machines manufactured by Stork N.V. of The Netherlands. Such machines typically employ a rotary screen through which the liquid (stiffening) material passes, depositing the material onto the substrate, with a second rotary screen positioned on the opposite side of the substrate during the application process. Such machines can be adapted not only for the purpose of applying the stiffener, but also in order to apply other materials, such as colors, adhesives and the like, to either or both sides of the substrate.

The application of stiffening agent to areas 52 leaves areas 54 untreated. As shown in FIG. 1, the untreated areas 54 in this embodiment are preferably relatively thin, straight lines arranged in a direction transverse to the longitudinal direction of the web 50. The selective application of stiffening agent forms a web 50 in which relatively large areas 52 are stiffened, and which are separated by thin, straight transverse lines which are unstiffened. It is therefore generally possible to apply these areas of stiffening agent by a variety of conventional printing processes.

Other techniques may also be employed to selectively stiffen the web. For example, a "patterned" calender-roll set may be employed, which would in effect "weld" the yarn intersections, increasing the stiffness in the desired ("welded") areas. The "pattern" of the heated calender-roll would be identical to the "print pattern" and yield similar results. Another such method would be to immerse the entire web into a "stiffening agent," followed by a drying/curing cycle, and to subsequently apply a "softener" onto the web in the areas where the hinging is desired, or "remove" the stiffener from the web in the desired hinging areas, with ultrasonic waves, or laser, or like methods.

As shown in FIG. 2, a selectively stiffened web, such as that described above, can be formed into an accordion pleated shade. In this configuration, the untreated and relatively soft areas 54 of the web 50 become hinges which can freely allow the shade to expand and collapse, while the areas 52 which are treated with a stiffening agent retain a substantial rigidity, thus giving the appearance of a pleated shade having relatively sharp "pleats." A conventional cord 56 can then be run through apertures formed in the stiffened areas 52 in order to allow the pleated shade to be opened and closed in a conventional fashion.

A second embodiment of the present invention is illustrated in FIGS. 3, 4, 5 and 6. In this embodiment, the present invention is employed to produce a "soft horizontal" window covering having two outer sheets of relatively transparent material with horizontally arrayed slats that can be rotated between an "open" and a "closed" position.

Figure 3:
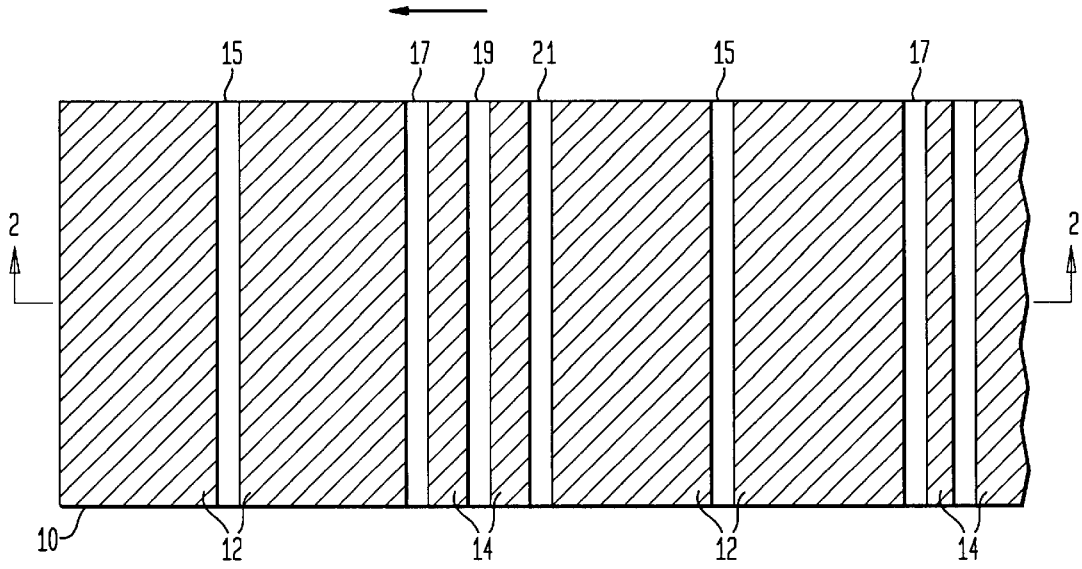
FIG. 3 is top, elevational view of another web of material useful in accordance with preparation of a window covering in accordance with the present invention.
Figure 4:
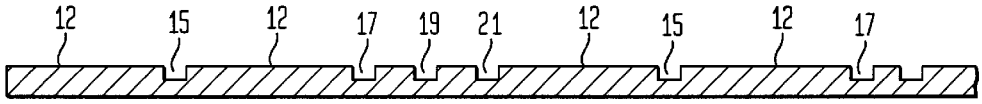
FIG. 4 is a side, sectional view of the web shown in FIG. 3.

FIGS. 3 and 4 illustrate schematically the web material that can be utilized to produce such window coverings. A pair of similar webs 10 will be used for the front and back sheets, which are required in this case. Webs 10 are lengths of flat material, again comprising the soft, non-rigid types of materials discussed above, which can be delivered off rollers to a processing station. The webs 10 are thus preferably manufactured from a tricot or warp knit material which is generally transparent and allows for light to be transmitted therethrough.

The webs 10 are once again selectively treated in a particular pattern with a stiffener of the type described above. As can be best seen in FIG. 3, the pattern in which the stiffener is applied to the web 10 consists of two longer stiffened segments 12, followed by two shorter stiffened segments 14. Each of these segments extends substantially across the entire transverse width of the web 10 for a predetermined longitudinal length so as to form the segments 12 and 14. Between each of these longer and shorter segments 12 and 14 are spaces 15, 17, 19, and 21, which are not treated with any stiffener and, accordingly, remain considerably more flexible than are those portions of the web 10 which have been treated with stiffening material. In addition to the stiffener, the short segments 14 may also be pre-treated at some early stage of the process with adhesive material, as is discussed in more detail below. That is, it may be desired to apply slats or the like to various preselected locations on the stiffened segments of the web 10, or in some cases, such as where the slats themselves have such adhesive material applied to preselected locations on their surface, it may not be necessary to apply the adhesive to these areas in the web.

Figure 5:
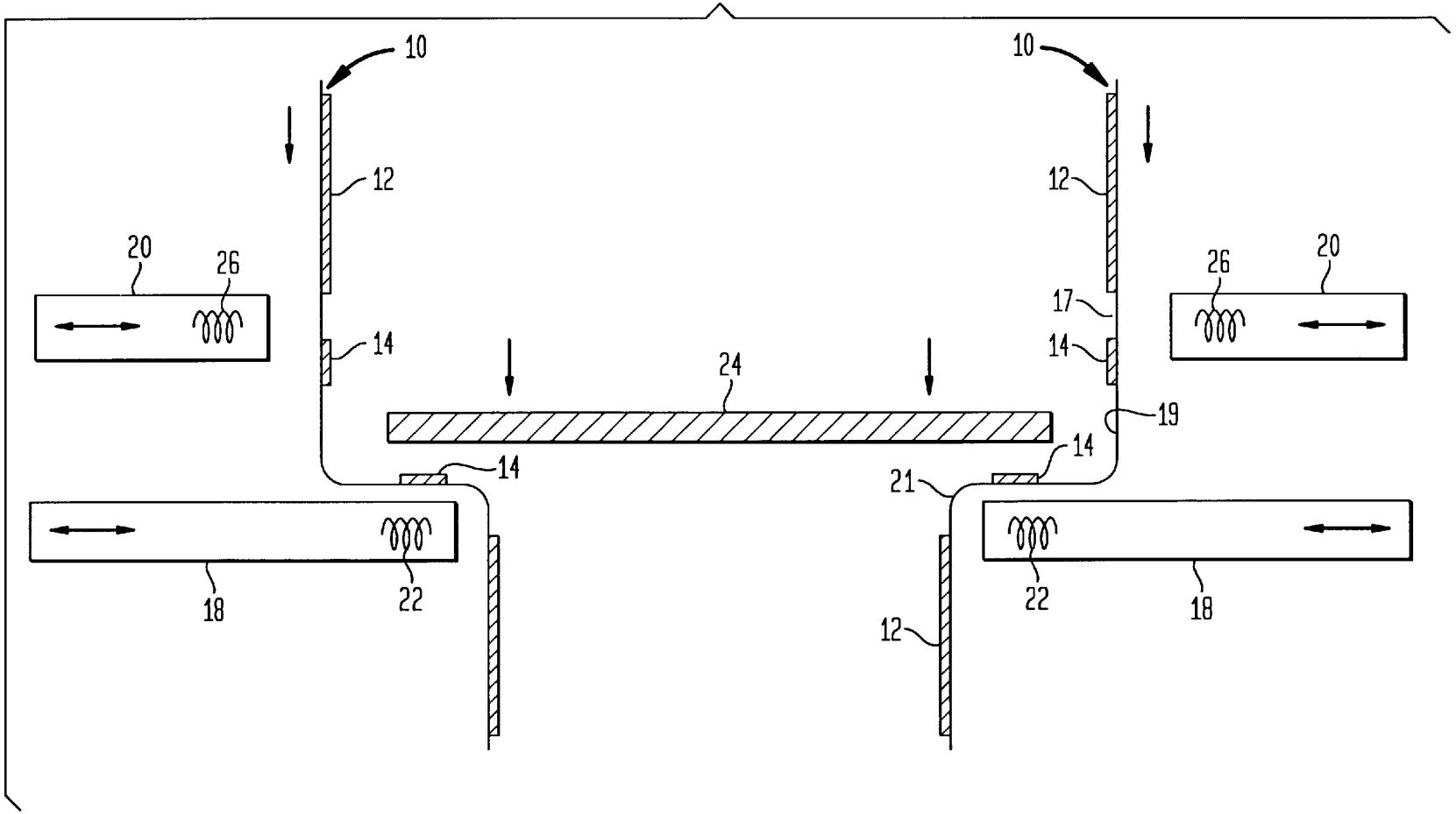
FIG. 5 is a front, elevational, partially schematic view of the preparation of a window covering in accordance with another embodiment of the present invention.

The assembly process for the embodiment shown in FIGS. 3 and 4 is generally illustrated schematically in FIG. 5. The pair of webs 10 enter the assembly area in a generally vertical, downward direction. The assembly area consists of two pairs of reciprocating knives, namely lower knives 18 and upper knives 20. In the initial position shown in FIG. 5, the lower knives 18 are extended inwardly, while the upper knives 20 are positioned outwardly, each case being described with respect to the vertical path of the webs 10 themselves.

The pair of webs 10 are also fed downwardly in a coordinated and timed fashion so that the pattern of longer and shorter segments of stiffener, 12 and 14, are positioned opposite each other in the assembly area. As can be seen in FIG. 5, the first of the two shorter stiffened segments 14 will reach a location at which they are positioned directly above and abutting the inwardly extended lower knives 18. That is, the lower knives 18 extending inwardly in the manner shown in FIG. 5 block the path of webs 10 causing the webs to curve inwardly before proceeding vertically therebelow. Therefore, as the timed webs 10 proceed downwardly in this coordinated manner the shorter segments 14 will eventually be located at that curved portion of the path of webs 10 created by knives 18 as shown in FIG. 5 to be directly below the ends of slat 24 between the two webs 10. At approximately this position, relatively opaque slats 24 are inserted in a generally downward direction toward the first shorter segments 14 and eventually are placed directly atop those shorter segments 14.

The slats 24 will have a bottom layer and a top layer. The bottom layer will consist of a thin flexible material and (unless the short segments 14 of the webs have been treated with adhesive) will be formed with heat-sensitive adhesive material on both the top and bottom surfaces. In the interior portion of each slat, a sheet of opaque fabric will be ironed onto the top surface, thus leaving edges of adhesive material at the outer margins which are adapted to be adhered to the outer webs 10. The slats 24 can be prepared in a number of other ways. In addition, application of the adhesive material to the selected portions of the top and/or bottom portions of the slat 24 can be effected in a manner similar to the application of a stiffened material to the web 10 itself. The adhesive can thus be applied with standard adhesive-applying equipment, printing-type equipment, and the like.

With the slat 24 generally in position as shown in FIG. 5, the upper reciprocating knives 20 may then move inwardly into position; i.e., to a position inwardly generally corresponding to that of the lower knives 18 shown in FIG. 5. The movement of the upper knives 20 will cause the trailing shorter segments 14 to be wrapped around and over the top portion of the slat 24. As may now be seen in the upper portion of FIG. 6, the slat 24 that is in the assembly area will now be positioned so that short stiffened segments 14 are wrapped on top and bottom of the outer edges of the slat 24. At about this stage, heating elements 22 in the lower knives 18 and heating elements 26 in the upper knives 20 are activated to apply heat to the short stiffened segments 14. This heat, when applied to the heat-sensitive adhesive material which had been applied to the slats 24 (or to the short segments 14), and which in either case is now present between the surface of short stiffened segments 14 and slats 24, forms a permanent bond such that the webs 10 are now fully attached to the slats 24. The foregoing step results in the formation of "tabs" on both the inner and outer surfaces of the product, with each tab consisting of top and bottom layers of the web material glued to and sandwiching within those two layers the outer single-layer fringes of the slats 24.

Figure 6:
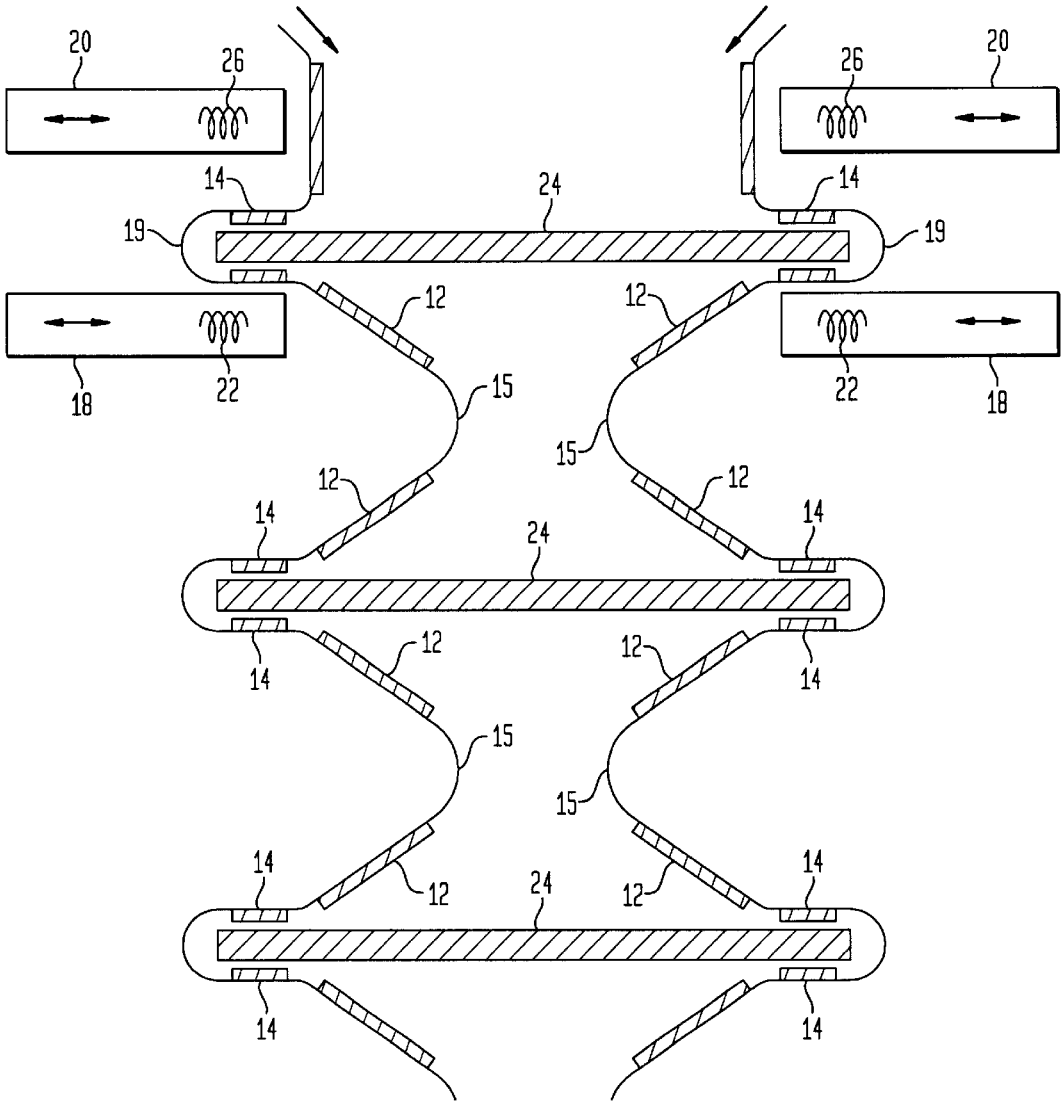
FIG. 6 is side, elevational, partially sectional view of preparation of the window covering shown in FIG. 5.

As can best be seen in FIG. 6, as the process is continued, the webs 10 (now carrying slats 24) advance downwardly. The portions of the web 10 that are between the slats 24 are urged inwardly by the lower knives 18 and form a stack of material. The spaces 15 between the two adjacent longer stiffened sections 12, which have not been treated with a stiffener, now tend to form inwardly directed pleats. As the completed material forms a tight stack, the "pleats" formed by the inwardly directed spaces 16 take on a "memory," such that when the completed material is expanded and then again allowed to contract, the material between the vanes will bend inwardly rather than outwardly.

Figure 6A:
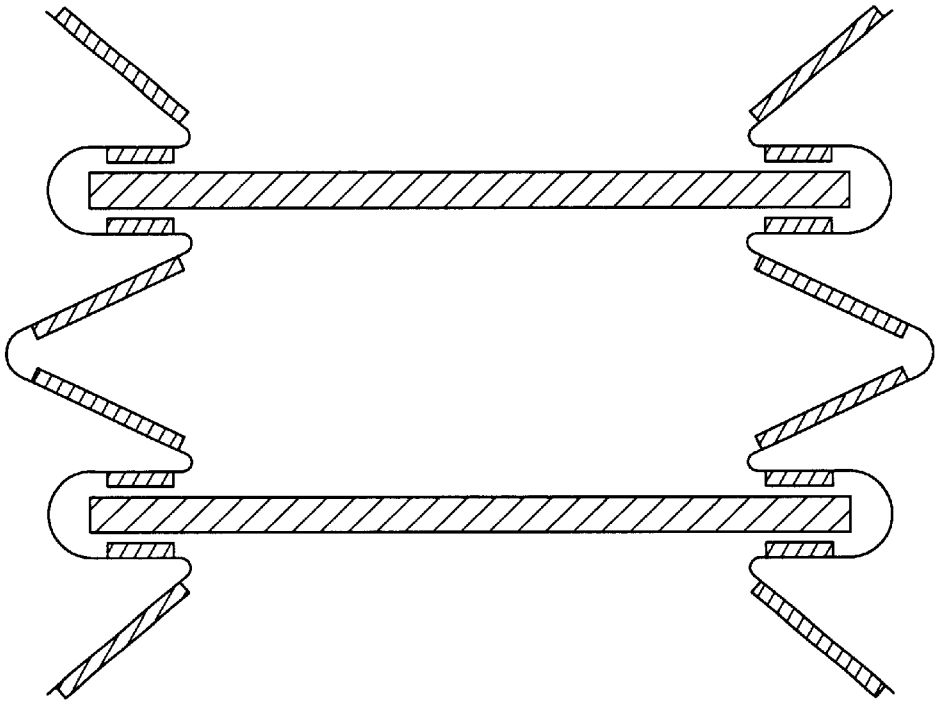
FIG. 6A is a side, elevational, partially schematic view of preparation of another window covering in accordance with the present invention.
Figure 6B:
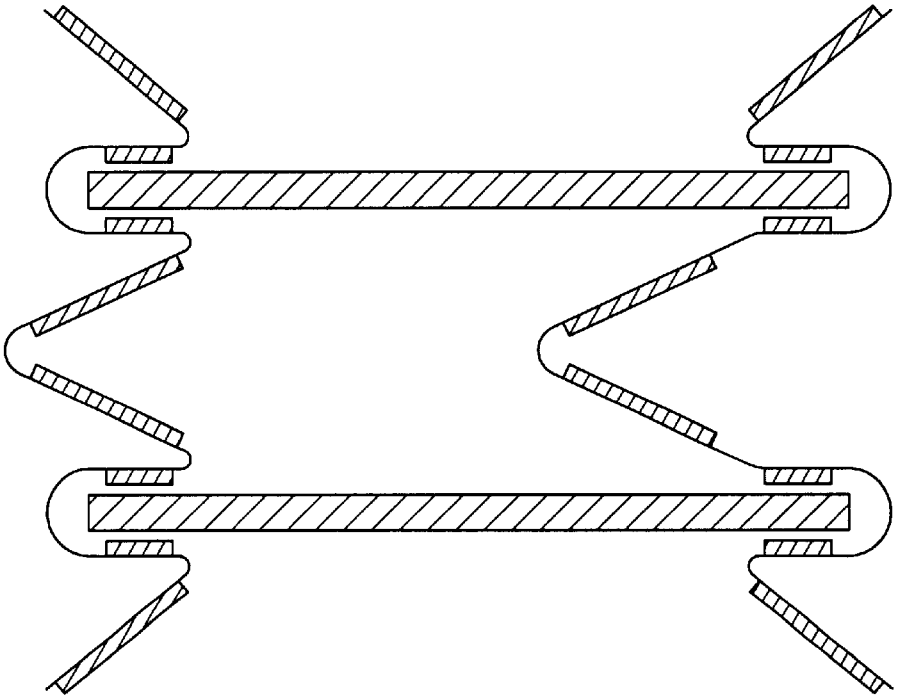
FIG. 6B is a side, elevational, partially schematic view of preparation of another window covering in accordance with the present invention.

As an alternative, both of the areas on the web which are not treated with the stiffener can be folded outwardly, so as to provide a configuration as shown schematically in FIG. 6A, or one such area can be folded inwardly and the other outwardly, so as to provide a configuration as shown schematically in FIG. 6B.

After heat has been applied, the lower knives 18 will withdraw outwardly, while the upper knives 20 move downwardly to assume the position previously taken by the lower knives 18. The two sets of knives 18, 20 will therefore actually "leapfrog" over each other in each cycle, with a given knife being "lower" in one cycle and "upper" in the next cycle.

The completed fabric may be cut into lengths which are appropriate to a given window covering. A bottom rail (not shown) will be attached to the lower portion of the window covering to provide sufficient weight to cause the material to expand. Lift cords will be provided by punching appropriate holes through the stack of vanes 24 at the specific locations at which the cords are to be placed, or alternatively through the tabs on the rear surface of the product, and threading an appropriate lift cord through the holes into an appropriate mechanism for lifting and releasing the lift cords. The upper portion of the window covering will be attached to a device which can rotate through an angle of approximately 180°. The rocking of the upper portion of the window covering will cause the front and back sheets to translate up and down relative to each other. This will cause the slats 24 to pivot. Since the slats 24 are opaque, the pivoting of the slats 24 will cause light to be blocked, first partially and then fully as the degree of rotation is increased.

When the window covering is in its equilibrium position with the slats 24 in a horizontal position, the light transmissibility will be at its maximum. Since the fabric on the front and rear portions of the shade have orientations which differ from each other, there will be no visible moire effect caused by the two sheets.

Figure 7:
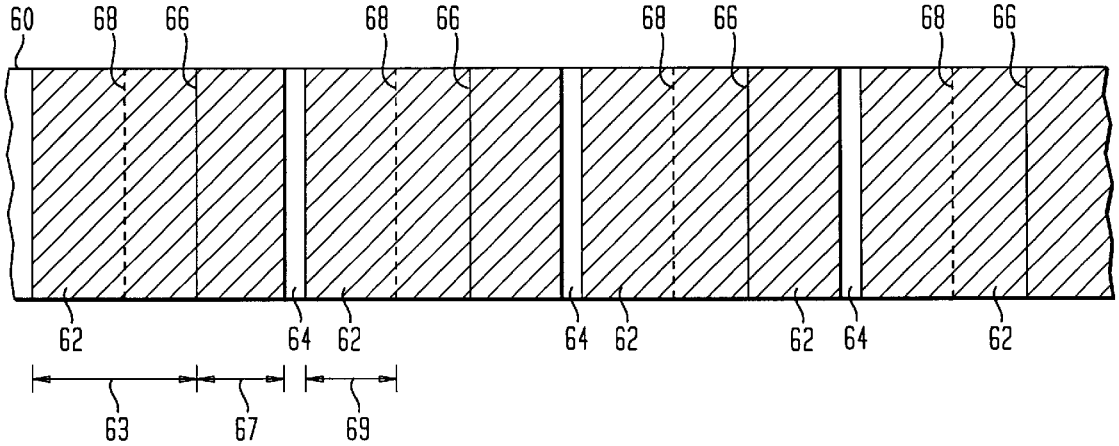
FIG. 7 is a top, elevational view of yet another web useful for the preparation of another embodiment of the window covering of the present invention.
Figure 8:
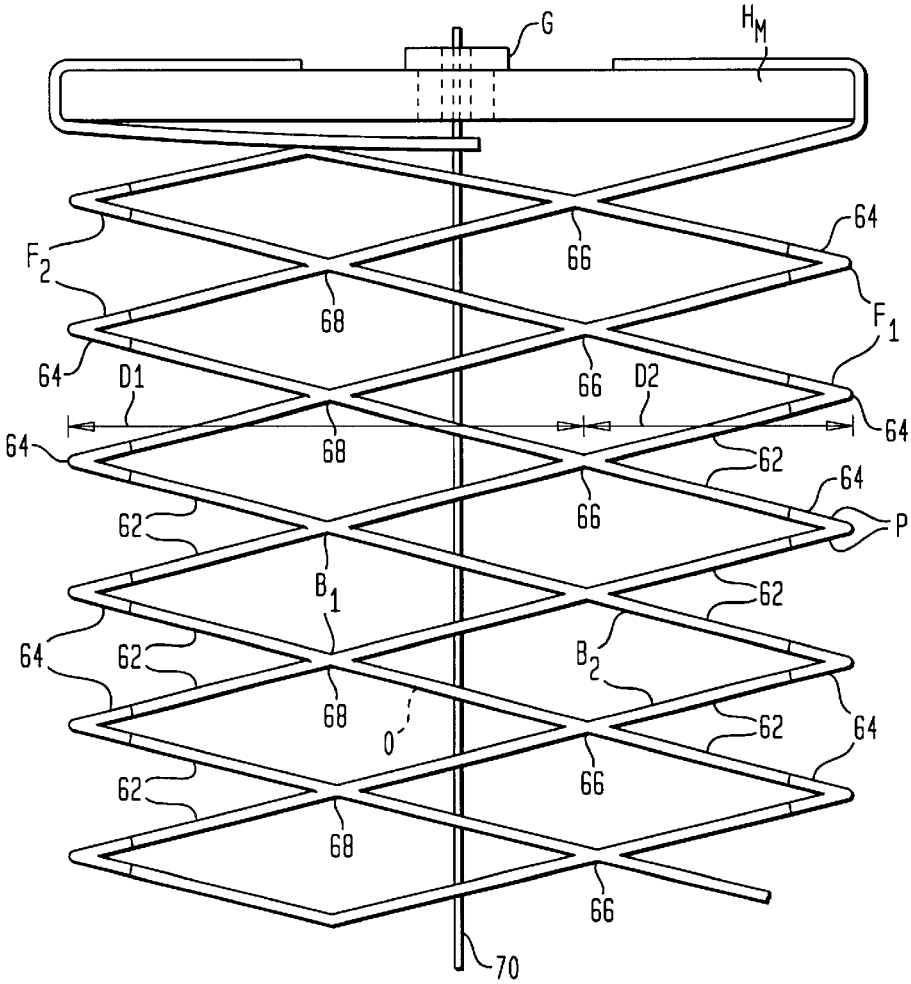
FIG. 8 is a side, elevational, partially sectional view of another window covering prepared in accordance with another embodiment of the present invention.

A third embodiment of the present invention is illustrated in FIGS. 7 and 8. This third embodiment is somewhat similar to the second embodiment, to the extent that it includes a continuous web 60 which includes stiffened portions 62 and intermediate portions 64 which are not treated with stiffener. However, in this third embodiment, in order to form a double-cell cellular shade as discussed below, lines of adhesive 66 are applied to the stiffened areas 62 on one surface (assumed herein to be the "top" surface). These adhesive lines 66 should be positioned within the stiffened areas 62 such that approximately two-thirds of each stiffened area 62 is on one side of the adhesive line 66, as shown by reference numeral 63 in FIG. 7, while the remaining one-third of the stiffened area 62 is on the other side of the adhesive line 66, as shown by reference numeral 67.

In addition to the adhesive lines 66 being placed on one surface of the selectively stiffened material as shown in FIG. 7, a second series of lines of adhesive 68, as shown by broken lines in FIG. 7, are placed on the reverse side of the material. The placement of the second series of adhesive lines 68 on the "bottom" of the fabric as shown in FIG. 7 is positioned such that within any given stiffened area 62, the top adhesive lines 66 and the bottom adhesive lines 68 divide the stiffened area 62 approximately in thirds. Stated differently, the "bottom" adhesive lines 68 also divide the stiffened area 62 into segments which are approximately one-third and two-thirds of their length, except that the one-third portion on the "top" of the web is the portion to the right of stiffened area 62 as shown in FIG. 7, while the one-third portion on the "bottom" is to the left-hand side as shown by reference numeral 68 in FIG. 7.

Figure 9:
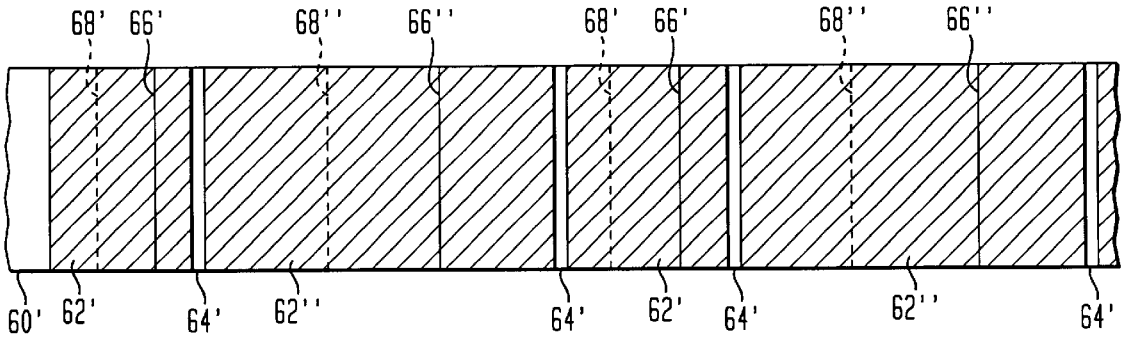
FIG. 9 is a top, elevational view of a portion of the web of material used to prepare a window covering in accordance with another embodiment of the present invention.

The web 60 which has been treated in this manner can now be formed into a double-cell cellular shade of the type illustrated in FIGS. 8–10 of U.S. Pat. No. 5,160,563, which patent is incorporated herein by reference. The aforesaid patent describes a method and apparatus for making a double-cell cellular shade which first involves the creation of accordion folds, followed by the application of adhesive in specifically selected zones, after which the web is refolded and the layers of material are joined to form a cellular shade product having two layers of staggered cells.

By employing the present invention, the creasing step may be obviated. Instead, a web of the type shown in FIG. 7 can be treated with lines of adhesive 66, and therein folded into a product having the configuration shown in FIG. 8.

An assembled window covering of this third embodiment is shown in FIG. 8. It will be appreciated that the unstiffened areas 64 become positioned at the outer extremities of the assembled product and thus act as pleats. The two sets of adhesive lines, 66 and 68, are employed to assemble the product, in much the same manner as in the aforesaid U.S. Pat. No. 5,160,563. Therefore, in this manner, upon folding the web with adhesive applied thereto as discussed above adjacent faces of the web are bonded together along the adhesive bands. Each adhesive band 66 and 68 is spaced from the associated unstiffened area 64 with a preceding panel a distance greater than one-half the width of the panel and preferably about two-thirds the width of the panel so that when the cellular structure is thereafter expanded, the sidewise adjacent panels that are united along the first creased folds F1 and bonded together along the first bands B1 define a first row of cells therebetween and the sidewise adjacent panels that are united along the second crease folds F2 and bonded together along the second bands B2 define a second row of cells therebetween, with the first and second rows of cells overlapping in the area between the bands Bi and B2, as shown in FIG. 8. A cord 70 allows the assembled product to be expanded and contracted by means of lifting a bottom rail (not shown).

In another embodiment employing the technique disclosed in U.S. Pat. No. 5,160,563 and discussed above for the formation of a double-cell cellular shade, a single-cell cellular shade can be produced. The technique employed to do so is a variation on the technique shown in the aforementioned U.S. Pat. No. 5,160,563, which technique is the subject of pending U.S. patent application Ser. No. 08/622,070, filed on Mar. 26, 1996, the disclosure of which is incorporated herein by reference thereto. In particular, in this embodiment which is illustrated in FIG. 9 and the aforementioned pending application Ser. No. 08/622,070, a continuous web 60' is provided including stiffened portions 62' and 62", and intermediate portions 64', which are not treated with stiffener. In this embodiment once again lines of adhesive 66' and 66" are applied to the stiffened areas 62' and 62", respectively, on one surface thereof. These adhesive lines 66' and 66" should again be positioned within the stiffened areas 62' and 62" such that approximately two-thirds of each stiffened area 62' and 62" is on one side of the adhesive line 66' and 66", respectively, again as shown in FIG. 9. The remaining one-third of the stiffened areas 62' and 62" are on the other side of the adhesive line 66' and 66". As can be seen, the area of these stiffened areas 62'and 62" vary considerably, with the area 62' being considerably smaller than the areas 62".

Furthermore, in addition to the adhesive lines 66' and 66" being placed on one surface of the selectively stiffened material as shown in FIG. 9, a second series of lines of adhesive 68' and 68", as shown by broken lines in FIG. 9, are placed on the reverse side of the material. Placement of the second series of adhesive lines 68' and 68" on the other surface of the fabric as shown in FIG. 9 is again positioned such that within any given stiffened area 62' or 62" the top adhesive line 66' or 66" and the bottom adhesive lines 68' and 68", again respectively, divide the stiffened areas 62' and 62" approximately into thirds.

Employing this structure in accordance with the method disclosed in pending application Ser. No. 08/622,070, one can then ultimately produce a single-celled product basically comprising the areas shown as 62", with the areas designed by 62' ultimately being removed in accordance with the process discussed in the pending application Ser. No. 08/622,070. Furthermore, if all of the stiffened areas 62' and 62" are produced in order to be "clear," i.e., without color, the single-celled product thus produced will be a single-celled cellular shade panel which does not include a light control material. On the other hand, by providing stiffened areas 62' and 62" in a "colored" format, such as by printing patterns or materials onto these portions, or only on stiffened area 62" as required, a light control form of the single-cell cellular shade panel can be produced.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An expandable and collapsible window covering comprising a web of non-rigid material and stiffening means intermittently applied to said web providing a plurality of stiffened regions along said web separated by regions of said non-rigid material, said regions of non-rigid material comprising narrow intermittent regions separating said plurality of stiffened regions whereby upon the collapse of said window covering said regions of said non-rigid material act as hinges and said plurality of stiffened regions are separated solely by the width of said hinges so as to provide the appearance of pleats located at said hinges without the necessity to provide separate creases between said plurality of stiffened regions to permit said web to be expanded and collapsed.

2. The window covering of claim 1 wherein said plurality of stiffened regions have a first longitudinal length along said web and said regions of non-rigid material have a second longitudinal length along said web, said first longitudinal length being greater than said second longitudinal length.

3. The window covering of claim 1 wherein said stiffening means is applied to at least one surface of said web.

4. The window covering of claim 3 wherein said stiffening means comprises a resin.

5. The window covering of claim 1 wherein said plurality of stiffened regions are applied to substantially said entire web.

6. The window covering of claim 1 wherein said stiffening means are applied by printing onto said web.

7. The window covering of claim 1 including a cord extending along said web in order to expand and collapse said web.

8. The window covering of claim 1 wherein said web comprises a first web, and said stiffening means comprises first stiffening means and including a second web of non-rigid material and connecting means for connecting said first web to said second web.

9. The window covering of claim 8 wherein said second web of non-rigid material includes second stiffening means intermittently applied to said second web providing a plurality of second stiffened regions along said second web separated by regions of said non-rigid material, whereby said regions of said non-rigid material can act as hinges between said plurality of second stiffened regions to permit said second web to be expanded and collapsed.

10. The window covering of claim 9 wherein said first and second webs comprise relatively transparent material.

11. The window covering of claim 9 wherein said connecting means comprises a plurality of slats joining said first web to said second web intermittently therealong.

12. The window covering of claim 2 including a pluraliy of first adhesive means associated with said stiffening means on a first side of said web and, a plurality of second adhesive means associated with said stiffening means on a second side of said web, said plurality of first adhesive means being affixed to said plurality of second adhesive means to form said window covering into a plurality of cells.

13. The window covering of claim 12 wherein each of said plurality of stiffening means includes one of said plurality of first adhesive means and one of said plurality of second adhesive means thereon.

14. The window covering of claim 13 wherein said stiffening means comprises a resin.

15. The window covering of claim 14 wherein said plurality of stiffened regions are applied substantially along said entire web whereby said regions of non-rigid material comprises narrow intermittent regions separating said stiffened regions.

16. An expandable and collapsible window covering comprising a first web of non-rigid material, first stiffening means intermittently applied to said first web providing a plurality of stiffened regions along said first web separated by regions of said non-rigid material, a second web of non-rigid material, second stiffening means intermittently applied to said second web providing a plurality of second stiffened regions along said second web separated by regions of said non-rigid material, whereby said regions of said non-rigid material can act as hinges between said plurality of first and second stiffened regions to permit said first and second webs to be expanded and collapsed, and connecting means comprising a plurality of slats joining said first web to said second web intermittently therealong, said first and second webs comprising relatively transparent material, wherein said first stiffening means comprises a first plurality of stiffening means intermittently applied to said first web providing a first plurality of stiffened regions along said first web separated by first regions of said non-rigid material and an alternating second plurality of stiffening means intermittently applied to said first web providing a second pluraliity of stiffened regions along said first web separated by second regions of said non-rigid material, said alternating first and second pluralities of stiffening means separated by third regions of said non-rigid material, and said second stiffening means comprises a first plurality of stiffening means intermittently applied to said second web providing a first plurality of stiffened regions along said second web separated by first regions of said non-rigid material and an alternating second plurality of stiffening means intermittently applied to said second web providing a second plurality of stiffened regions along said second web separated by second regions of said non-rigid material, said alternating first and second pluralities of said stiffening means separated by third regions of said non-rigid material.

17. The window covering of claim 16 wherein said first pluralities of stiffened regions on said first and second webs have a first longitudinal length and said second pluralities of stiffened regions on said first and second webs have a second longitudinal length, said first longitudinal length being greater than said second longitudinal length.

18. The window covering of claim 17 wherein said first regions of said non-rigid material on said firsthand second webs have a third longitudinal length, said second regions of said non-rigid material on said first and second webs have a fourth longitudinal length, and said third regions of said non-rigid material on said first and second webs have a fifth longitudinal length, said first longitudinal length being greater than said third, fourth and fifth longitudinal lengths.

19. The window covering of claim 18 wherein said third, fourth and fifth longitudinal lengths are substantially the same.

20. The window covering of claim 18 wherein said plurality of slats are affixed to said first and second webs at said second plurality of stiffened regions along said, first and second webs, whereby said first regions of said non-rigid material along said first and second webs act as said hinges between said plurality of slats.

21. The window covering of claim 20 wherein said plurality of slats are affixed to said second plurality of stiffening means by means of adhesives.

22. The window covering of claim 20 including a bottom rail affixed to said first and second webs, and lift cords affixed to said bottom rail and adjacent to one of said first and second webs whereby upon lifting of said lift cords one of said first and second webs is translated relative to the other of said first and second webs thereby causing said slats to pivot thereabout.

* * * * *

UNITED STATES PATENT AND TRADEMARK OFFICE

CERTIFICATE OF CORRECTION

PATENT NO. : 6,302,181 B1
DATED : October 16, 2001
INVENTOR(S) : John D. Rupel

It is certified that error appears in the above-identified patent and that said Letters Patent is hereby corrected as shown below:

Column 8,
Line 39, "moire" should read -- moiré --.

Column 9,
Line 39, "Bi" should read -- B1 --.

Column 11,
Line 21, after "and" delete ",".

Column 12,
Line 26, delete "firsthand" and insert therefor -- first and --.

Signed and Sealed this

Ninth Day of April, 2002

*Attest:*

*Attesting Officer*

JAMES E. ROGAN
*Director of the United States Patent and Trademark Office*